US005571032A

United States Patent [19]

Sano et al.

[11] Patent Number: 5,571,032

[45] Date of Patent: Nov. 5, 1996

[54] COUPLED HOUSING TYPE CONNECTOR

[75] Inventors: Takahiro Sano, Shizuoka; Hiroshi Okamoto, Niimi, both of Japan

[73] Assignee: Yazaki Corporation, Tokyo, Japan

[21] Appl. No.: 311,061

[22] Filed: Sep. 23, 1994

[30] Foreign Application Priority Data

| | | | |
|---|---|---|---|
| Sep. 24, 1993 | [JP] | Japan | 5-237737 |
| Dec. 14, 1993 | [JP] | Japan | 5-313035 |
| Jun. 14, 1994 | [JP] | Japan | 6-131565 |

[51] Int. Cl.[6] ..... H01R 13/40

[52] U.S. Cl. ..... 439/589; 439/595

[58] Field of Search ..... 439/695, 587, 439/589, 595, 598, 697, 586, 599

[56] References Cited

U.S. PATENT DOCUMENTS

| | | | |
|---|---|---|---|
| 3,840,839 | 10/1974 | Smaczny et al. | 439/589 |
| 3,970,352 | 7/1976 | Dorrell et al. | 439/595 |
| 4,358,179 | 11/1982 | Bourdon et al. | 439/595 |
| 4,820,204 | 4/1989 | Batty | 439/695 |
| 4,961,713 | 10/1990 | McCracken et al. | 439/589 |

FOREIGN PATENT DOCUMENTS 2-278673 11/1990 Japan .

*Primary Examiner*—Hien D. Vu

*Attorney, Agent, or Firm*—Armstrong, Westerman, Hattori, McLeland & Naughton

[57] ABSTRACT

This invention is intended to provide a coupled housing type connector, whose housing is split in two, an outer housing and an inner housing, so that by coupling the split housing portions together, terminals can easily be inserted and fitted in position even when the terminal locking position lies in a narrow and deep structure of the connector. Wires that are passed through the sealing rubber plug are connected with the terminals, which are installed in the terminal accommodating chambers in the inner housing. The inner housing and the rubber plug are fitted into the outer housing so that the electric contact portions of the terminals project from the terminal leadout openings formed in the partition wall of the outer housing.

5 Claims, 12 Drawing Sheets

COUPLED HOUSING TYPE CONNECTOR

BACKGROUND OF THE INVENTION

1. Field of the Invention

The present invention relates to a coupled housing type connector used mainly in electric wiring installed in narrow spaces, as in a speed change gear mechanism of an automatic transmission.

2. Description of the Prior Art

The automatic transmission used in automobiles consists generally of a torque converter and a speed change gear mechanism, which incorporates wires and connectors leading to external circuits for electronic control of gear.

Japanese Patent Preliminary Publication No. Heisei-2-278673 proposes a connector K, shown in FIG. 20, for such a speed change gear mechanism.

The connector K is made by pressing an inner plate h (see FIG. 21) rigidly fitted with a terminal a into a casing c and fixing it in the casing, and then pouring a molding resin into the casing c to seal it. Because the molding resin used is the one with a high hardness, such as epoxy resin, to increase the terminal retaining force, the resin is easily cracked deteriorating the sealing performance. Further, because in the wire connecting work it is necessary to pierce the wire through the casing c and a rubber plug d, the wire termination becomes complicated, lowering the work efficiency.

SUMMARY OF THE INVENTION

This invention has been accomplished with a view to overcoming the above-mentioned problems and a primary object of this invention is to provide a coupled housing type connector, whose housing is split in two so that by coupling the split housing portions together, the terminal can easily be inserted and fitted in position even when the terminal locking position lies in a narrow and deep structure.

To achieve the above objective, the coupled housing type connector of this invention comprises:

- a cylindrical outer housing having a partition wall formed with a plurality of terminal leadout openings;
- an inner housing having a plurality of terminal accommodating chambers;
- a sealing rubber plug; and
- a plurality of terminals to be installed in the terminal accommodating chambers;
- wherein wires passed through the rubber plug and introduced into the terminal accommodating chambers are connected with the terminals, and the inner housing and the rubber plug are fitted into the outer housing in such a way that electric contact portions of the terminals project from the terminal leadout openings formed in the partition wall.

Further, it is preferred that the terminals to be installed in the terminal accommodating chambers have an erected piece that engages with the partition wall of the outer housing.

It is also desirable that one of walls of each terminal accommodating chamber be formed with a resilient restraining piece that holds down the terminal installed in each terminal accommodating chamber of the inner housing.

It is also desirable that the partition wall of the outer housing be provided with separation walls for the resilient restraining pieces, and that the inner housing be provided with separation wall insertion openings to receive the separation walls.

Further, it is preferred that the inner housing be provided with locking projections extending toward the rubber plug, and that the rubber plug be provided with locking recesses to receive the locking projections.

Because the coupled housing type connector of this invention has the housing of the connector split into an outer housing and an inner housing and because the inner housing is fitted into the outer housing after the terminals are installed in the terminal accommodating chambers of the inner housing, the coupling process of the split housings causes the electric contact portions of the terminals installed in the terminal accommodating chambers to project from the terminal leadout openings in the partition wall of the outer housing and the terminals to be automatically locked between the inner housing and the partition wall of the outer housing. Hence, even when the terminal is incompletely installed in the terminal accommodating chamber, the pushing of the inner housing into the outer housing causes the terminal to be inserted to the specified position easily. Therefore, this invention is suited for connectors with a narrow and deep structure.

The terminals are each provided with an erect piece, which abuts against the partition wall causing the terminals to be correctly positioned and locked in the terminal accommodating chambers.

As described above, one of the walls of each terminal accommodating chamber is formed with the resilient restraining piece, which holds down the terminal in the terminal accommodating chamber of the inner housing. This eliminates an excess play of the terminals installed in the terminal accommodating chambers of the inner housing, assuring a smooth insertion of the terminals during assembly work.

Because the connection between a terminal and a wire and the installation of a terminal in the terminal accommodating chamber can be done on one side of the inner housing, i.e., on the rubber plug side, the work efficiency improves significantly.

Furthermore, if, as mentioned above, the inner housing is securely combined with the rubber plug through the locking projections that are engaged in the locking recesses formed in the rubber plug, it is possible, during the process of passing wires through the inner housing and connecting the wires with terminals, to prevent the inner housing from coming off or moving along the wires that were already inserted through the inner housing. This also improves work efficiency.

DETAILED DESCRIPTION OF PREFERRED EMBODIMENT

Figure 1:
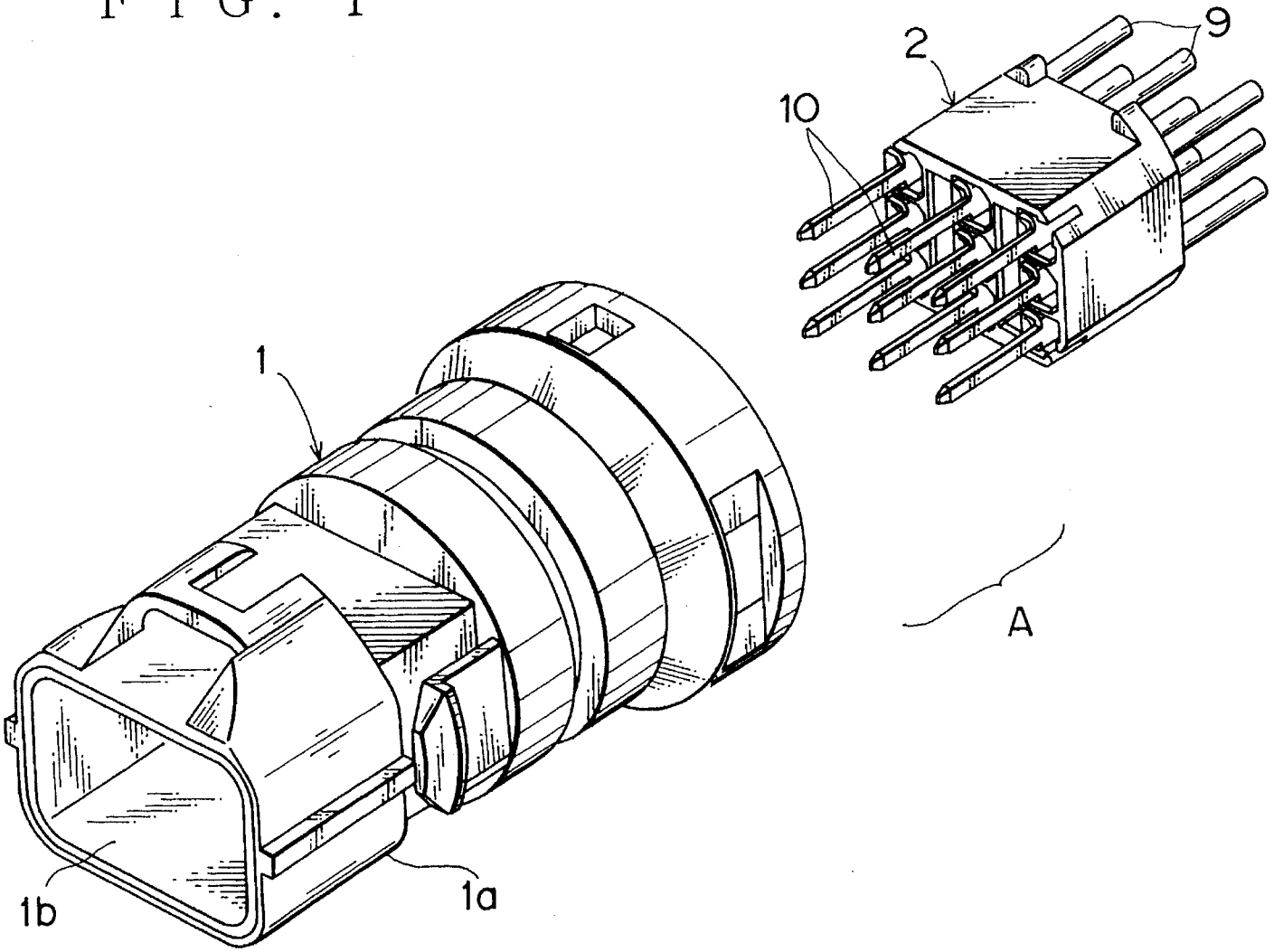
FIG. 1 is a perspective view of the coupled housing type connector, as one embodiment of this invention, whose outer housing and inner housing are shown separated from each other.

FIG. 1 is a perspective view showing an outer housing 1 and an inner housing 2 separated from each other, both constituting the coupled housing type connector A which is one embodiment of this invention.

Figure 2:
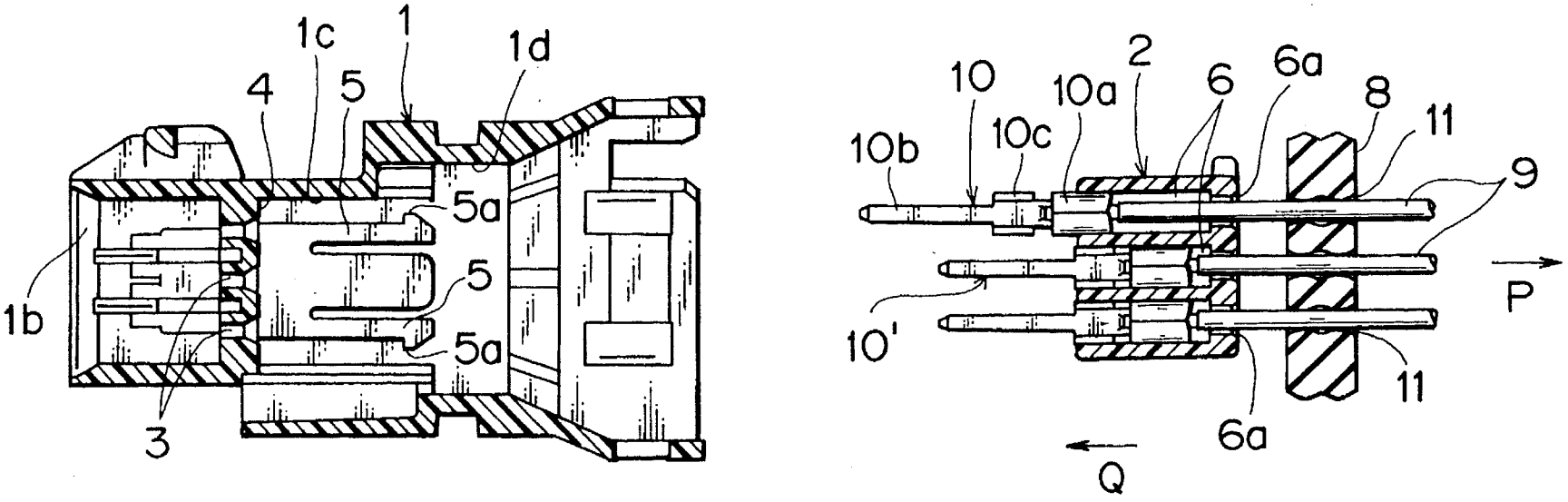
FIG. 2 is a cross section of the outer housing, the inner housing, the terminals and the rubber plug of FIG. 1.

The outer housing 1, as shown in FIG. 2, has an engagement opening 1*b* formed at one end of a cylindrical body 1*a* for engagement with a mating connector. Inside the outer housing 1 there is a partition wall 4 formed with a plurality of terminal insertion holes 3. Behind the partition wall 4, a locking hook or locking wall means 5 to lock the inner housing 2 is projected from the partition wall 4 like a cantilever.

Figure 3:
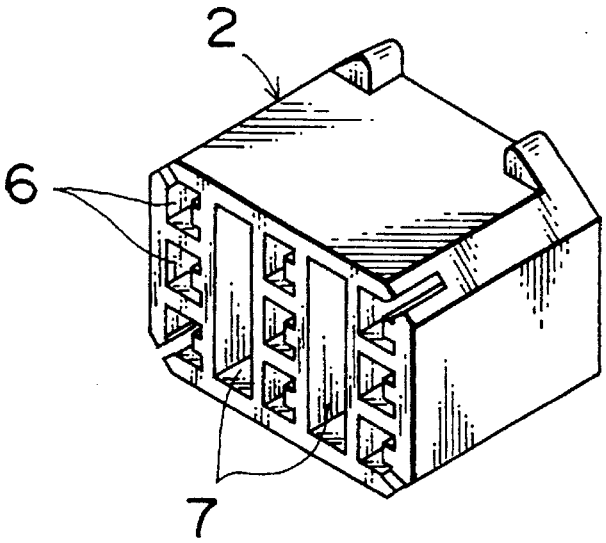
FIG. 3 is a perspective view of the inner housing of FIG. 2, as seen from a direction in which it is fitted into the outer housing.
Figure 4:
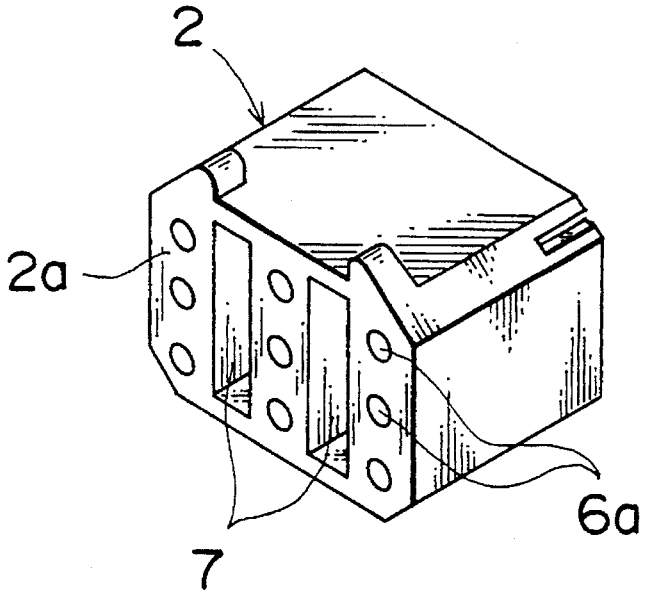
FIG. 4 is a perspective view of the inner housing of FIG. 3 as seen from the opposite direction.

The inner housing 2, as shown in FIG. 3 and 4, has its outer portion formed into a shape that can fit into a housing accommodating portion 1*c* formed in the inner wall of the outer housing 1. In its interior, the inner housing 2 has a plurality of terminal accommodating chambers 6 and two locking hook insertion openings 7 for accommodating the locking hook 5 of the outer housing 1.

At its rear wall 2*a* the inner housing 2 is formed with wire insertion holes 6*a* (see FIG. 4) that communicate with the terminal accommodating chambers 6. Wires 9 that have passed through the sealing rubber plug 8 are inserted through the wire insertion holes 6*a* into the terminal accommodating chambers 6 for connection with terminals 10.

The sealing rubber plug 8 is formed into a shape that closely fits into a sealing wall 1*d* of the outer housing 1, and has a plurality of wire insertion holes 11 formed therein that correspond to the terminal accommodating chambers 6 in the inner housing 2.

The terminal 10 is made by bending a conductive metal plate and is of a male type, which has an electric contact portion 10*b* at the front and, at the rear, a wire connecting portion 10*a* having a crimp portion that expands like a wing. The rear portion also has an erected piece 10*c* between the wire connecting portion 10*a* and the electric contact portion 10*b*.

Next, the process of assembling these components into the coupled housing type connector A will be explained.

First, the wires 9 are passed through the wire insertion holes 11 in the rubber plug 8 and then into the wire insertion holes 6*a* in the inner housing 2. The front ends of the wires 9 are drawn out of the terminal accommodating chambers 6. Then the insulation at the wire end is peeled, and the bare wire is put on the wire connecting portion 10*a* of the terminal 10 and crimped. FIG. 2 shows the wires and the terminals crimped together.

Then, the wires 9 are pulled back in the direction of arrow P to temporarily lock the crimped terminals 10 in the terminal accommodating chambers 6 (in the state of terminal 10' of FIG. 2).

The inner housing 2 with the terminals 10 temporarily locked in the terminal accommodating chambers 6 is pushed into the outer housing 1 in the direction of arrow Q to insert the electric contact portions 10*b* of the terminals 10 through the terminal insertion holes 3 in the partition wall 4 of the outer housing 1 so that the electric contact portions 10*b* project from the partition wall 4 toward the engagement opening 1*b*.

Figure 5:
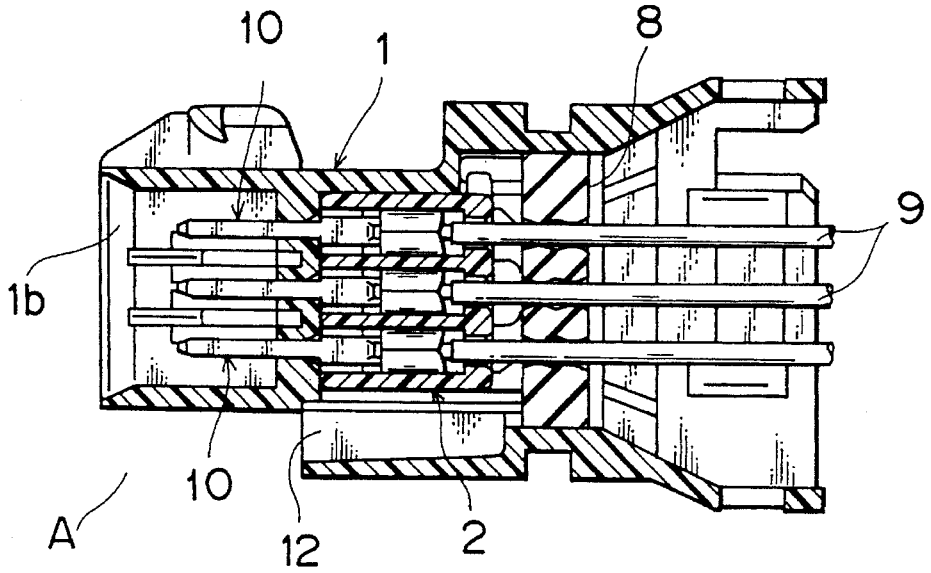
FIG. 5 is a cross section showing the inner housing and outer housing of FIG. 2 coupled together.

At this time, the erected pieces 10*c* of the terminals 10 abut against the partition wall 4 thereby securely locking the terminals 10 in the respective terminal accommodating chambers 6. At the same time, the locking hook or locking wall means 5 of the outer housing 1 is inserted into the locking hook insertion holes 7 in the inner housing 2. As a result, locking claws 5*a* of the locking hook 5 engage with the rear wall 2*a* of the inner housing 2, thus locking the outer housing 1 and the inner housing 2, as shown in FIG. 5.

If, in this engagement process, the terminal 10 of the inner housing 2 fails to be pulled back to the specified position, i.e., the terminal 10 is in a half-inserted state, the action of pushing the inner housing 2 causes the erect piece 10*c* of the terminal 10 to be pressed against the partition wall 4, with the result that the terminal 10 is automatically located at the specified position in the terminal accommodating chamber 6.

After the outer housing 1 and the inner housing 2 are connected together, the rubber plug 8 is fitted into the sealing wall 1*d* of the outer housing 1 and at the same time the elastic silicon resin is poured in through a filler injection port 12 to seal the inner housing 2. In this way, the coupled housing type connector A is obtained.

Figure 6:
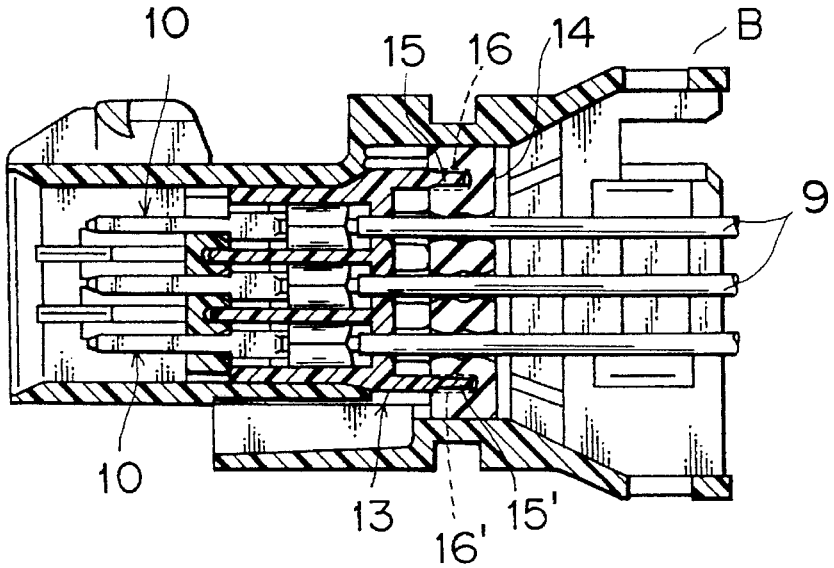
FIG. 6 is a cross section of another embodiment of the coupled housing type connector according to this invention.

FIG. 6 is a longitudinal cross section of a coupled housing type connector B as a second embodiment of this invention.

Figure 7:
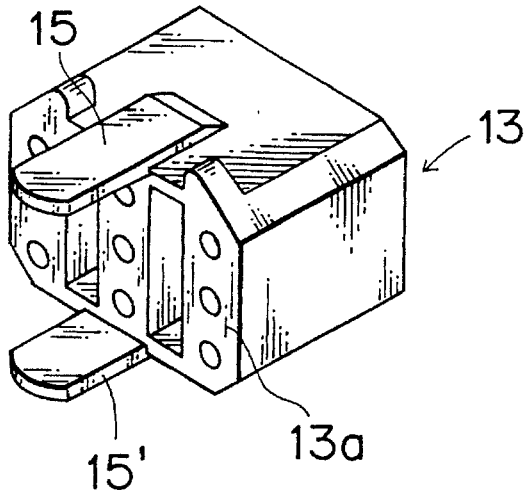
FIG. 7 is a perspective view of the inner housing of FIG. 6.
Figure 8:
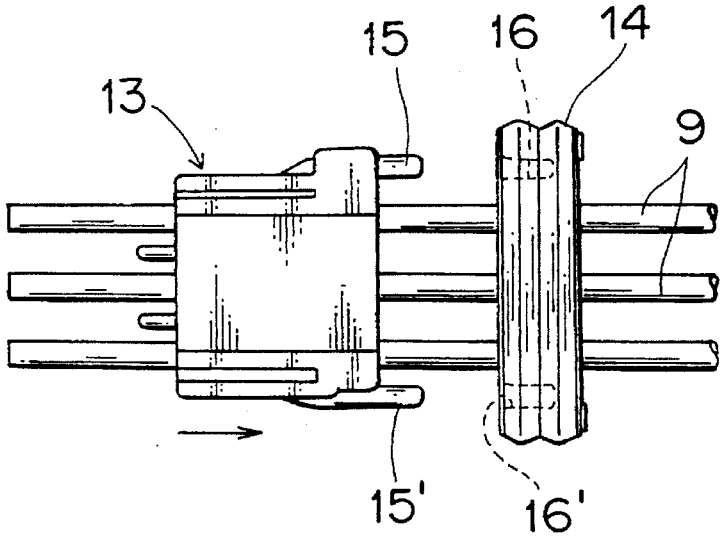
FIG. 8 is a side view showing the wires passing through the inner housing of FIG. 7 and a rubber plug.

An inner housing 13 making up the coupled housing type connector B, as shown in FIG. 7, is provided with locking projections 15, 15' that extend from a rear wall 13*a* of the inner housing 13 toward a rubber plug 14. As shown in FIG. 8, the rubber plug 14 is formed with locking recesses 16, 16' that accepts the locking projections 15, 15'. Other parts are similar to those of the coupled housing type connector A.

In the process of assembling the coupled housing type connector A, the wire 9 after being passed through the rubber plug 8 and the inner housing 2 is crimped with the terminal 10. At this time, the inner housing 2 may slip off or move along the wires 9, making the crimping work difficult.

Figure 9:
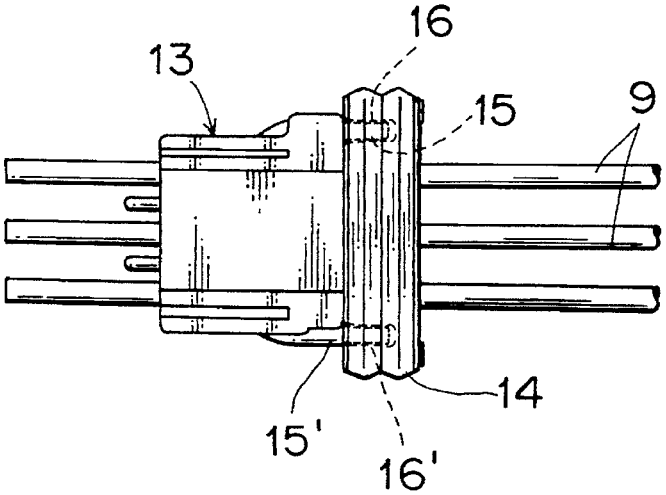
FIG. 9 is a side view showing the inner housing and rubber plug of FIG. 8 fitted together.
Figure 10:
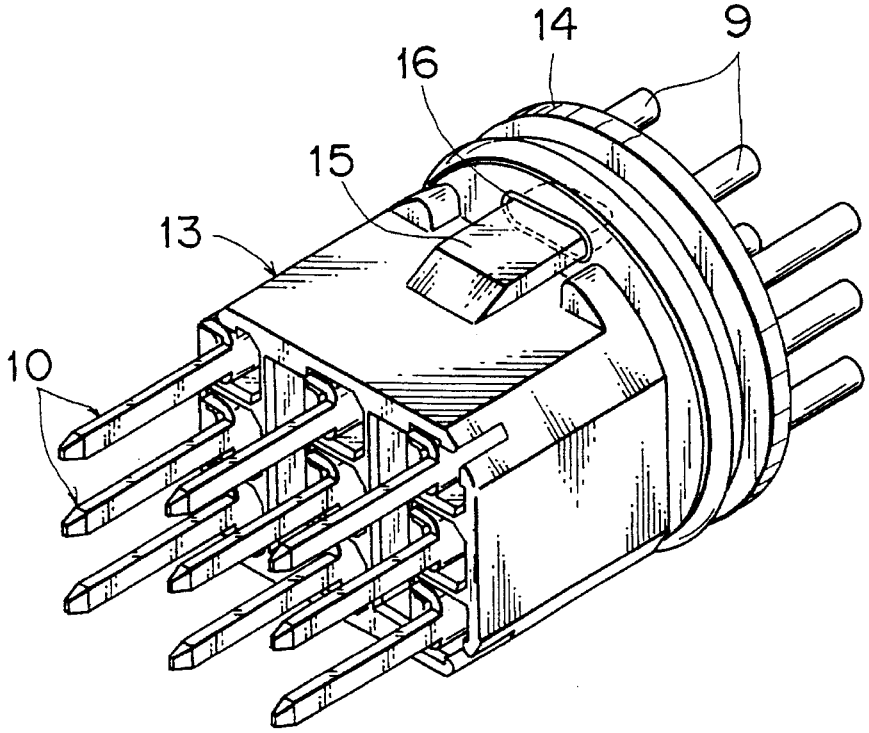
FIG. 10 is a perspective view of the inner housing of FIG. 9 with terminals fitted therein.

With the coupled housing type connector B, on the other hand, when the wire 9 is inserted through the rubber plug 14 and the inner housing 13 and is crimped with the terminal 10, the inner housing 13 is first moved in the direction of arrow and, as shown in FIG. 9, the locking projections 15, 15' of the inner housing 13 is fitted into the locking recesses 16, 16' of the rubber plug 14 to fix the inner housing 13 and the rubber plug 14 together before the terminal 10 is crimped. FIG. 10 is a perspective view showing the inner housing 13 with the terminals 10 and the wires 9 connected.

Because the inner housing 13 and the rubber plug 14 are combined together as mentioned above, the inner housing 13 is prevented from slipping off or moving along the wires 9 when performing the terminal crimping work, allowing the crimping of terminals 10 to be performed smoothly.

Figure 11:
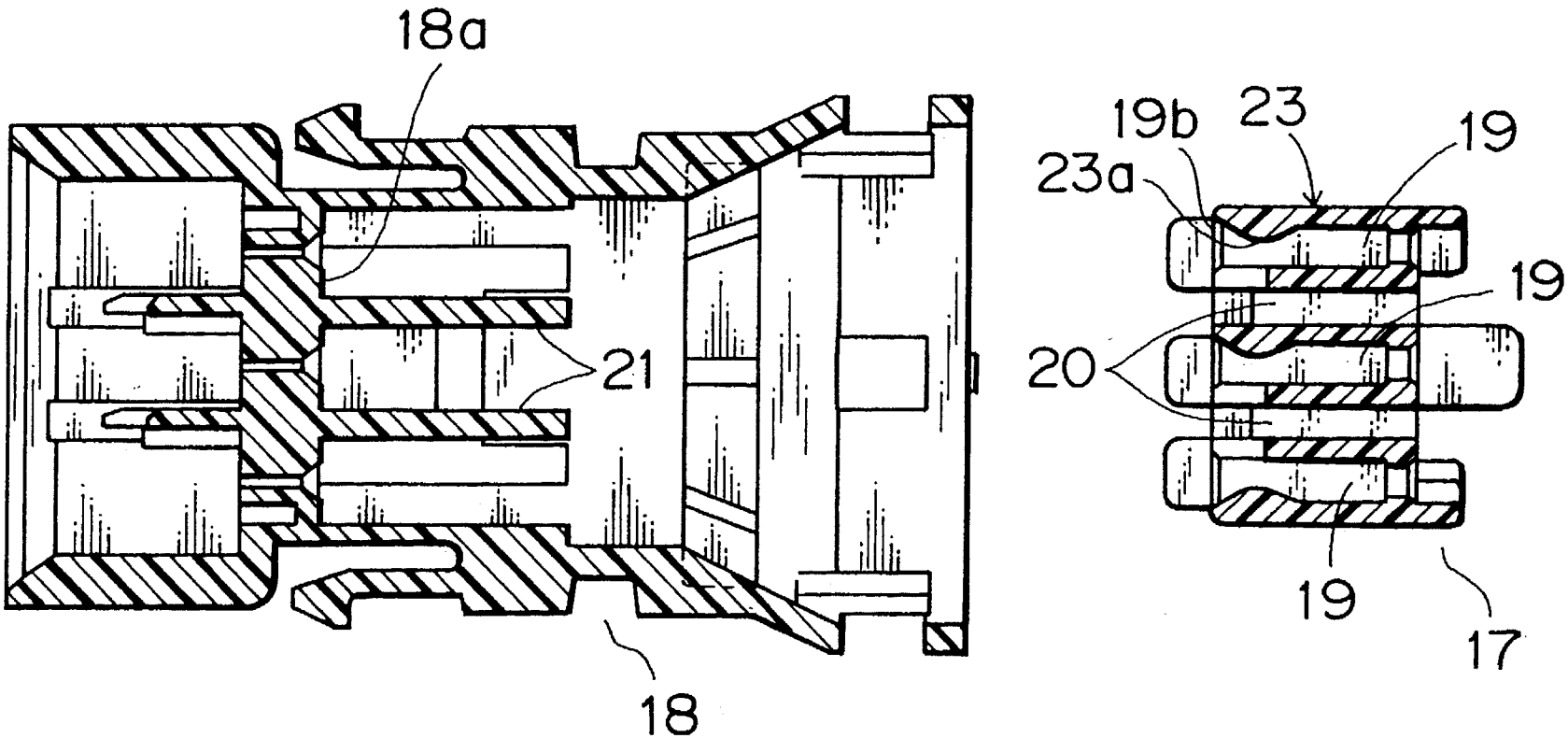
FIG. 11 is a cross section showing an inner housing and an outer housing of still another embodiment of the coupled housing type connector according to this invention.

FIG. 11 is a longitudinal cross section of a coupled housing type connector C as still another embodiment of this invention, showing an inner housing 17 and an outer housing 18.

Figure 12:
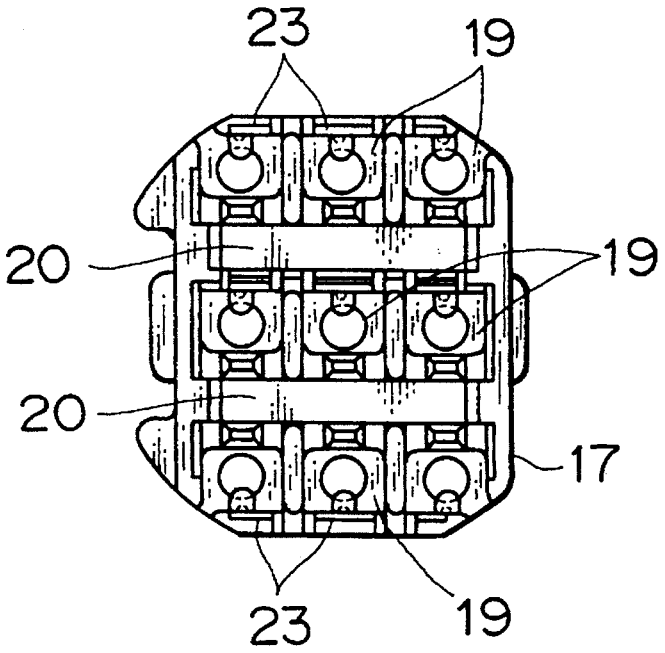
FIG. 12 is a front view of the inner housing of FIG. 11.

The inner housing 17, as shown in FIG. 12, is formed with three tiers of three laterally arranged terminal accommodating chambers 19 with separation wall insertion holes 20 interposed between the tiers. A partition wall 18*a* of the outer housing 18 is provided with separation walls having a pair of locking wall means 21 extending rearwardly for insertion into the separation wall insertion holes 20 in the inner housing 17.

Figure 13:
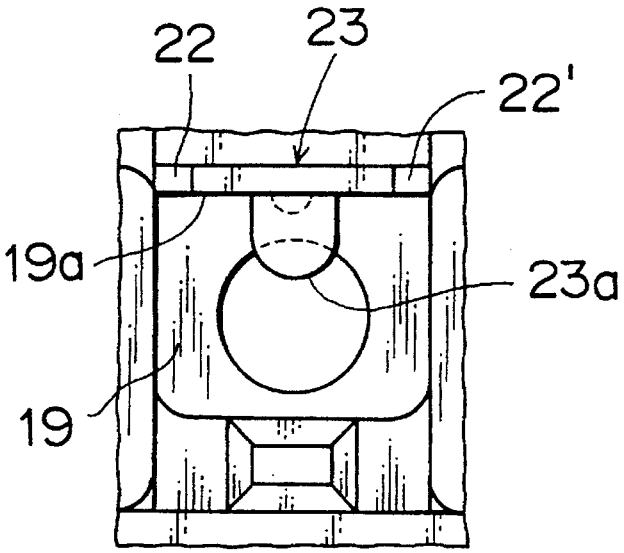
FIG. 13 is an enlarged front view of a terminal accommodating chamber of FIG. 12.

One of walls 19*a* of each terminal accommodating chamber 19 is formed with cuts 22, 22' extending from the opening end 19*b* on the outer housing engagement side, as shown in FIG. 13, to form a resilient restraining piece 23. The resilient restraining piece 23 has a restraining projection 23*a* at the free end, which by the resiliency of the restraining piece 23 is movable almost perpendicularly to the direction in which the terminal is inserted into the terminal accommodating chamber 19.

Figure 14:
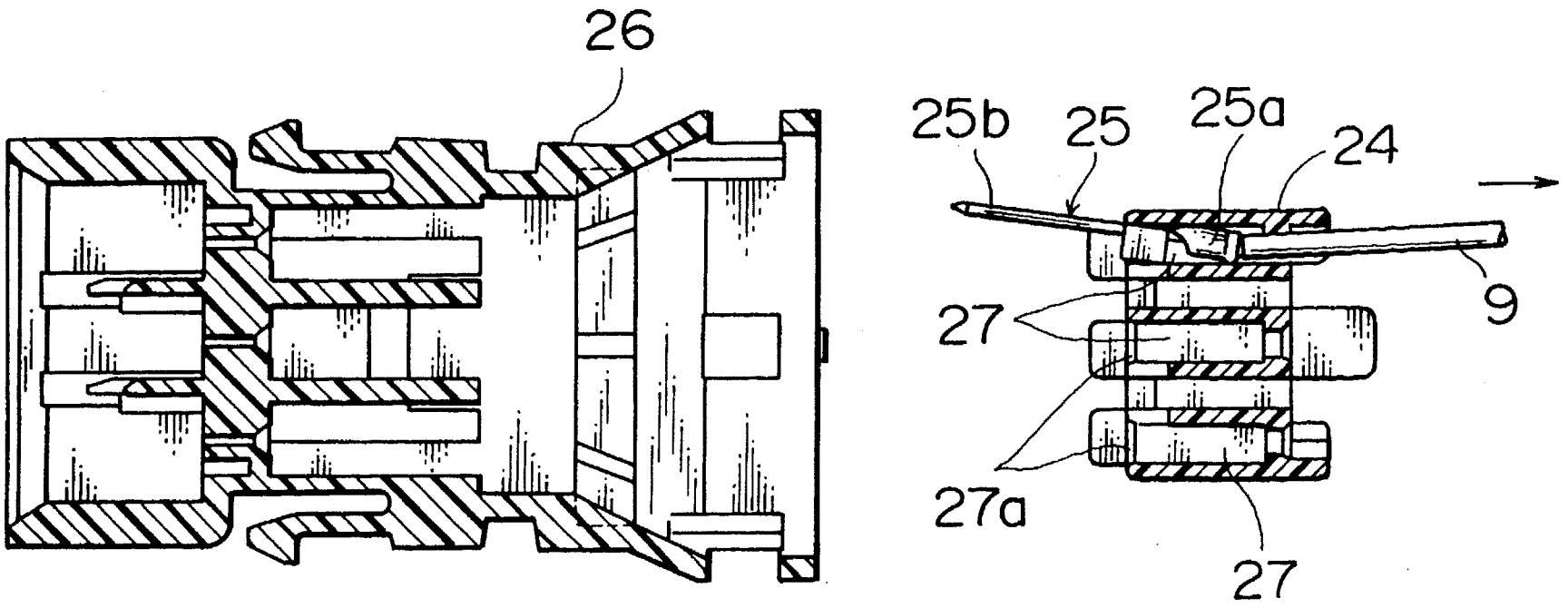
FIG. 14 is a cross section showing, for comparison, one example of inner housing with no resilient restraining piece of FIG. 11.
Figure 15:
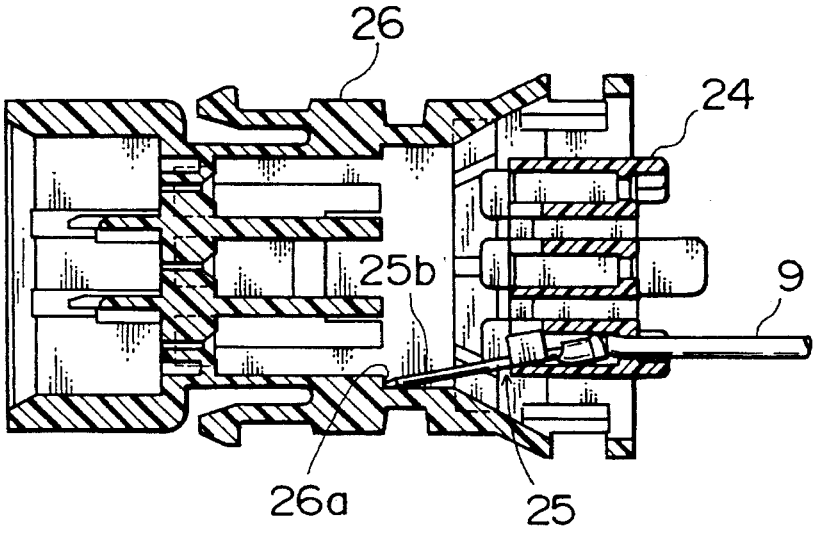
FIG. 15 is a cross section showing the process of inserting the inner housing into the outer housing of FIG. 14.

Next, the action of the resilient restraining piece 23 will be explained. For comparison, let us explain about the problems encountered by an inner housing 24 having no resilient restraining piece 23, as shown in FIG. 14, when a terminal 25 is inserted into the inner housing 24. Designated 26 is an outer housing.

The process of inserting the terminal 25 into the inner housing 24, as already described in the case of the coupled housing type connector A, consists of passing the wire 9 through the inner housing 24, crimping the wire 9 with the terminal 25, and pulling back the wire 9 in the direction of arrow to locate the terminal 25 at a specified position in the terminal accommodating chamber 27 of the inner housing 24.

The opening 27*a* of the terminal accommodating chamber 27 is set large enough to allow the wire connecting portion 25*a* of the terminal 25 where the wire 9 is crimped to pass therethrough in order to draw the wire connecting portion 25*a* into the terminal accommodating chamber 27. For this reason, after the terminal 25 is located at a specified position in the terminal accommodating chamber 27, the electric contact portion 25*b* of the terminal 25 may become inclined because of a play between it and the opening 27*a*, giving rise to a problem that the electric contact portion 25*b* abuts against a stepped portion 26*a* of the outer housing 26 making it impossible to engage the inner housing 24 or to insert the electric contact portion 25*b* into a terminal leadout opening 28. To eliminate a play requires the use of a special tool or jig to align the position of the electric contact portion 25*b* of the terminal 25 in each terminal accommodating chamber 27 and also complicated adjustments.

In the coupled housing connector C, therefore, the resilient restraining piece 23 is provided in each terminal accommodating chamber 19 of the inner housing 17 to eliminate the play of the electric contact portion 25*b* of the terminal 25 received in the chamber 19 and thereby prevent the electric contact portion 25*b* from becoming inclined.

Figure 16:
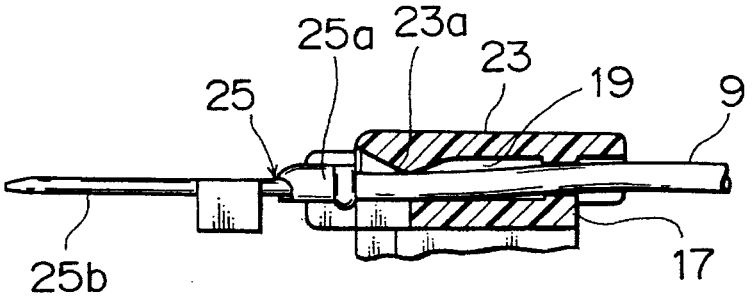
FIG. 16 is a fragmentary cross section showing the process of inserting a terminal into the terminal accommodating chamber of FIG. 11.
Figure 17:
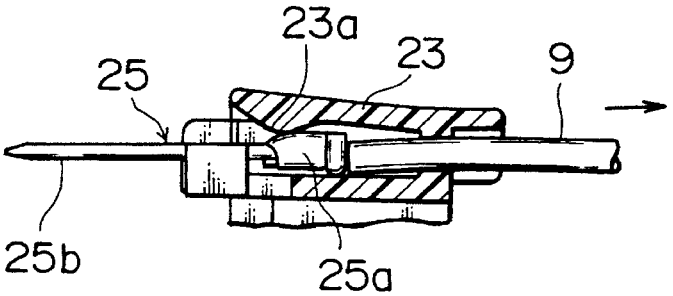
FIG. 17 is a fragmentary cross section showing the wire of FIG. 16 being pulled back.
Figure 18:
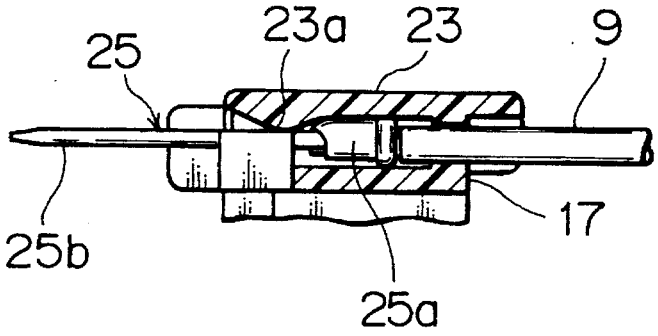
FIG. 18 is a fragmentary cross section showing the terminal in its intended position in the terminal accommodating chamber.
Figure 19:
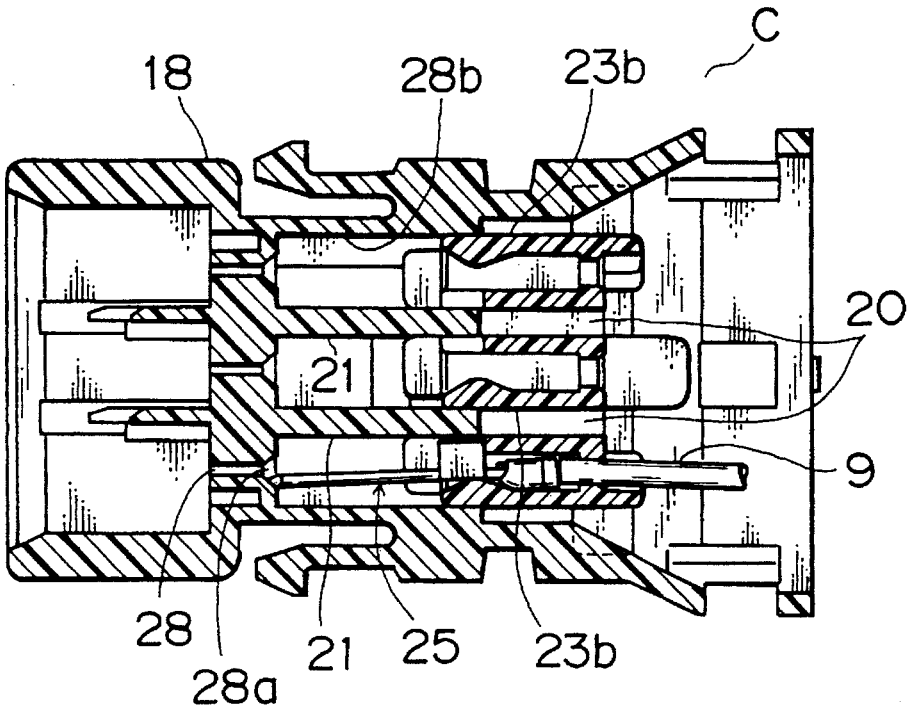
FIG. 19 is a cross section showing the inner housing being inserted into the outer housing of FIG. 11.
Figure 20:
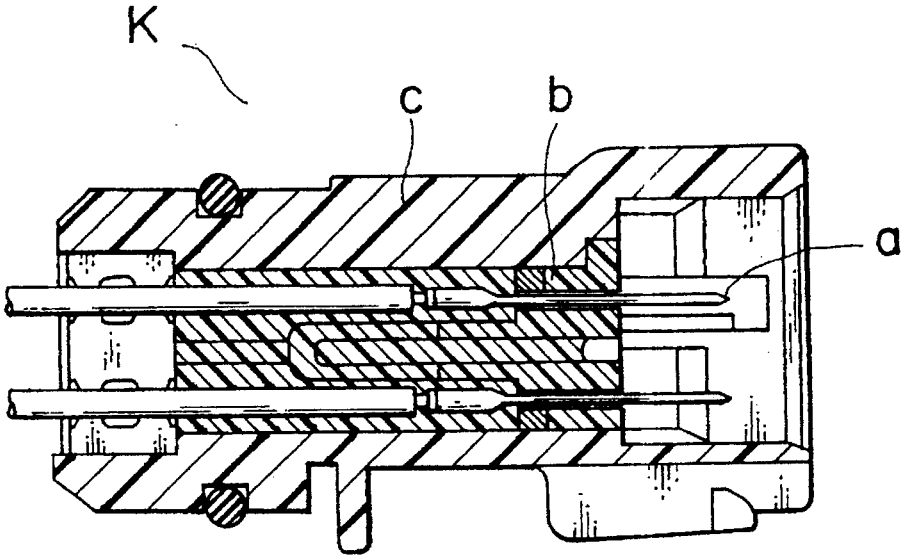
FIG. 20 PRIOR ART
FIG. 20 is a cross section of a conventional connector.
Figure 21:
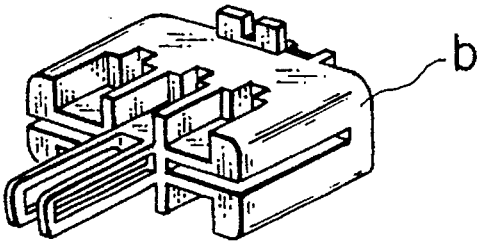
FIG. 21 PRIOR ART
FIG. 21 is a perspective view of an inner plate of FIG. 20.

To describe in more detail, as shown in FIG. 16, after the end of the wire 9 is crimped to the wire connecting portion 25*a* of the terminal 25 outside the terminal accommodating chamber 19, the wire 9 is pulled back in the direction of arrow of FIG. 17 to install the terminal 25 in the terminal accommodating chamber 19. During this process, the wire connecting portion 25*a* of the terminal 25 pushes up the restraining projection 23*a* of the resilient restraining piece 23, deflecting the resilient restraining piece 23 outwardly. Then, when the terminal 25 is installed in the specified position, the restraining projection 23*a* snaps back to its original position by the resiliency of the restraining piece 23 as shown in FIG. 18, with the result that the electric contact portion 25*b* of the terminal 25 is pressed down by the restraining projection 23*a*, preventing the electric contact portion 25*b* from tilting due to a play.

Hence, without using a special tool, it is possible to correctly align the electric contact portions 25*b* of the terminals 25 in all terminal accommodating chambers 19 of the inner housing 17. The slight play remaining with the electric contact portion 25*b* can be absorbed and corrected by a tapered portion 28*a* formed in the terminal leadout opening 28 of the outer housing 18, along which the electric contact portion 25*b* is slid, thus permitting the inner housing 17 fitted with the terminals 25 to be easily engaged in the outer housing 18.

When the inner housing 17 is fitted into the outer housing 18, the separation walls 21 of the outer housing 18 are inserted into the separation wall insertion holes 20 in the inner housing 17. At this time, because the back 23*b* of the resilient restraining piece 23 is supported or reinforced by the separation walls 21 or the housing accommodating portion 28*b* at the inner wall of the outer housing 18, the restraining projection 23*a* of the resilient restraining piece 23 can be prevented from being deflected outwardly of the terminal accommodating chamber 19 as it otherwise would by the pressing force of the wire connecting portion 25*a* of the terminal 25.

After the inner housing 17 is fitted into the outer housing 18, the rubber plug is amounted, followed by the charging of a filler to form the coupled housing type connector C, in the same way as the preceding connector A.

Because the coupled housing type connector C has the resilient restraining piece 23 in each terminal accommodating chamber 19 of the inner housing 17, a play of the terminals inserted into the terminal accommodating chambers 19 can be eliminated and the electric contact portions 25*b* of the terminals 25 are correctly aligned, thereby facilitating the smooth and easy engagement between the outer housing 18 and the inner housing 17, preventing unwanted deflection of the resilient restraining piece 23 by the separation walls 21 or housing accommodating portion 28*b* of the outer housing 18, allowing the terminals 25 to be held stably.

When the terminal 25 is not inserted at a specified position in the terminal accommodating chamber 19, i.e., the terminal is in a half-inserted state, the resilient restraining piece 23 will not return to the original position, remaining projected into the separation wall insertion hole 20, with the result that the separation walls 21 of the outer housing 18 cannot be inserted into the separation wall insertion holes 20. This prevents the housings with incompletely inserted terminals from being assembled undesirably.

What is claimed is:

1. A coupled housing type connector comprising:

a one piece insulative cylindrical outer housing having locking wall means integrally formed therein and an inner peripheral wall integrally formed with a partition wall located within said outer housing approximately perpendicularly to said inner peripheral wall, said partition wail having a plurality of terminal leadout openings approximately perpendicularly therethrough;

an inner housing having an inner periphery which forms a plurality of terminal accommodating chambers;

a sealing rubber plug having wire insertion holes therethrough;

a plurality of terminals each having two ends with a first end including an electric contact portion, a second end including a wire connecting portion and an erected piece located between said electric contact portion and said wire contacting portion so that said wire connecting portion and said erected piece of each of said terminal is housed in said terminal accommodating chambers;

a plurality of wires each having two ends with a first end passed through each of said wire insertion holes of said rubber plug and being housed in each of said terminal accommodating chambers adjacent said wire connecting portion of each of said terminals;

wherein said inner housing is connected to said rubber plug by said wires so that said inner housing and rubber plug are fitted into said outer housing in such a way that electric contact portions of said terminals project outwardly from said terminal leadout openings formed in said partition wall: and wherein said locking wall means engages with interior portions of said inner housing.

2. The coupled housing type connector according to claim 1, wherein said erected piece of each of said terminals engages with said partition wall of said outer housing.

3. The coupled housing type connector according to claim 1, wherein said terminal accommodating chambers are each formed with a resilient restraining piece means for holding down said respective terminal installed in each of said terminal accommodating chambers of said inner housing.

4. The coupled housing type connector according to claim 3, wherein said partition wall of said outer housing is provided with separation wall means for receiving said resilient restraining piece means, and said inner housing is provided with separation wall insertion recess means for receiving said locking wall means.

5. The coupled housing type connector according to claim 1, 2, 3 or 4, wherein said inner housing is provided with locking projections extending toward said rubber plug, and said rubber plug is provided with locking recess means for receiving said locking projections.

* * * * *